US007290465B2

(12) United States Patent
Gao et al.

(10) Patent No.: US 7,290,465 B2
(45) **Date of Patent: *Nov. 6, 2007**

(54) RATCHET DRIVER AND METHOD OF MAKING SAME

(75) Inventors: Hua Gao, Fox Point, WI (US); James A. Rinner, Racine, WI (US)

(73) Assignee: Teleflex Medical Incorporated, Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/488,915

(22) Filed: Jul. 19, 2006

(65) Prior Publication Data

US 2007/0084313 A1 Apr. 19, 2007

Related U.S. Application Data

(60) Provisional application No. 60/700,195, filed on Jul. 19, 2005.

(51) Int. Cl.

| | |
|---|---|
| ***B25B 13/00*** | (2006.01) |
| ***B25B 13/46*** | (2006.01) |
| *B25B 15/00* | (2006.01) |

(52) U.S. Cl. ..... 81/62; 81/63.1

(58) Field of Classification Search ..... 81/62, 81/63.1

See application file for complete search history.

(56) References Cited

U.S. PATENT DOCUMENTS

| | | | | |
|---|---|---|---|---|
| 6,997,084 | B1 | 2/2006 | Gao et al. | 81/62 |
| 7,036,399 | B1 * | 5/2006 | Gao et al. | 81/58.4 |
| 7,168,342 | B2 * | 1/2007 | Gao et al. | 81/58.4 |

* cited by examiner

*Primary Examiner*—David B Thomas
(74) *Attorney, Agent, or Firm*—Baker & Hostetler LLP

(57) ABSTRACT

A ratcheting driver configured to rotationally drive an item or work piece is provided. The driver includes a handle and pivotal pawls engageable with a driven gear and capable of ratcheting and driving in both rotational directions. The handle and pawls have mating matched surfaces for full and flush overlying contact therebetween. A cap that is rotatable relative to the handle and that has a web for pivoting the pawls out of engagement with the gear is also provided. In addition, a stop is included. The stop is configured to assure that only a correct direction of rotation of the cap is available when assembling. Also, a method of arranging the driver is provided.

8 Claims, 3 Drawing Sheets

12
18
16
16
27
27
34
26
37
39
38
23, 24
23, 24
41

RATCHET DRIVER AND METHOD OF MAKING SAME

CROSS-REFERENCE TO RELATED APPLICATIONS

This application claims priority to provisional U.S. patent application entitled, RATCHET DRIVER AND METHOD OF MAKING SAME, filed Jul. 19, 2005, having a Ser. No. 60/700,195, the disclosure of which is hereby incorporated by reference in its entirety.

Also, this relates to U.S. patent application Ser. No. 10/746,633, filed Dec. 29, 2003 and issued as U.S. Pat. No. 6,997,084 B1. There is common inventorship and a common owner for the present application, the above-referenced application, and the above-referenced patent. The disclosures of the above-referenced application and patent are incorporated into this present disclosure.

FIELD OF THE INVENTION

Certain embodiments of the present invention relate generally to ratchet drivers and to methods of making ratchet drivers. More particularly, certain embodiments of the present invention relate to ratcheting drivers which have pivotal pawls. The invention is particularly applicable to ratchet screwdrivers and also where there are two pawls which are pivotal between the driving and released positions for respective rotation inducement and free ratcheting movement.

BACKGROUND OF THE INVENTION

Ratcheting drivers are currently available to those skilled in applying fasteners, and in performing like actions. Such drivers commonly include a handle and an actuator thereon. Such drivers also commonly include a driven gear and pawl assembly, all for maneuvering the actuator for selectively setting the assembly for rotational driving in either direction while allowing ratcheting in the direction opposite the driving direction.

SUMMARY OF THE INVENTION

At least one embodiment of the present invention improves upon currently-available drivers by presenting a ratcheting driver which firmly transmits an optimum amount of torque through the gear and pawl assembly. In accomplishing this objective, the driver according to this embodiment is relatively easily manufactured, inexpensive, durable, can be miniature, and is reliable.

In using a ratcheting driver, torque is typically applied from a user's hand to the handle, then to the pawl, then to the gear, and then to the driven tool bit and/or to the work piece (e.g., a screw, nut, or bolt). According to certain embodiments of the present invention, it is important to have the assembly arranged for optimum transmission of the applied hand torque. Such optimization is often dependent upon the construction, mounting, and location of the pawls. Certain embodiments of the present invention achieve the optimum arrangement for transmitting that optimum torque, and do so in a reliable and consistent manner.

Certain embodiments of the present invention include pivotal pawls which are supported in pockets of the driver handle and, under the force of the rotation torque being applied, the pawls cannot then pivot out of their engaged position with the gear. That is, according to certain embodiments of the present invention, the rotation force applied through the handle serves to secure the pawls in the engaged position. As such, according to these embodiments, there is a relationship between the handle and the pawls to effect the securement of the engaged pawls without any forces tending to tilt the pawl. According to these embodiments, the torquing force, as applied to the pawls themselves, serves to enhance security for the engagement of the teeth which will remain engaged while driving.

According to certain embodiments of the present invention, the pawls have a stability with the handle and the gear to always remain aligned therewith and thereby have full and aligned contact with the gear during maximum torque transmission. Also, according to some of these embodiments, in the driving mode, the forces on the pawls from the handle are in a direction to enhance the force of engagement of the pawl with the gear teeth to thereby remain in full and secure driving contact. In fact, according to certain embodiments of the present invention, there can be more than one angular direction of the forces from the handle to the pawl, and thus there can be, for example, two simultaneously applied forces from the handle to the engaged pawl. Those two forces may, for example, be applied to spaced-apart locations, both of which urge the pawl into firm tooth engagement with the gear, as is desired.

Another important feature of certain embodiments of the present invention is that, in these embodiments, the pawls are disengaged from the gear by a camming action applied by a control that slidably engages the pawls for pivoting the pawls off the gear to thereby disengage the pawls. In such an arrangement, the control is selectively moved to respective positions relative to the respective pawl to pivot the prawl off of the gear. In that action, the control and the pawl have mutually engaging surfaces for effecting the pivoting action, and that produces the camming action.

As will be appreciated by those of skill in the art, that is in contrast to currently available practice of pushing pawls out of the way to free the pawls from gear engagement. As such, currently available pawls are tenuously positioned in their engaged positions. In contrast, according to certain embodiments of the present invention, the disengaging force on the pawl is in a direction of a force-component radially directed relative to the longitudinal axis of the gear.

Regarding the foregoing, according to certain embodiments of the present invention, the pawls can extend axially beyond the length of the gear teeth, and an actuator web is arranged for pivoting the pawl off of the gear from underneath the pawl. That is, according to some of these embodiments, the web extends to a location radially inward on the pawl to lift the pawl off the gear.

The driver cap according to certain embodiments of the present invention has a web which serves to rotationally release the pawls, so no additional pawl actuator member is required to serve as a pawl release. According to some of these embodiments, release is accomplished with one integral cap with a web which pivots the respective pawls off of the gear.

Additionally, according to certain embodiments of the present invention, the pawls are utilized for limiting the rotation of the cap when using the cap for ratcheting and driving adjustments. According to some of these embodiments, the pawls themselves are placed in rotative obstruction so the cap cannot be rotated too far until the cap is intentionally released.

According to still other embodiments of the present invention, the gear is rotatably supported at its two ends which flank the gear teeth. Therefore, according to some of these embodiments, the tendency to cock or tilt currently available gears is eliminated because the gear according to certain embodiments of the present invention is held stable against the driving forces. Also, according to certain embodiments of the present invention, the pawls extend beyond the axial length of the gear teeth, and thusly the web which actuates by pivoting the pawls can contact the pawls from underneath at the extending lengths to lift the pawls for pivoting. This is in direct contrast to pushing the pawls off to one side, as is currently done.

Further, according to certain embodiments of the present invention, the driver provides for precision and, therefore, firm gear teeth engagement between the handle carrying the two pawls and the driven gear. The gear may be small, at least relative to currently available ratchet drivers. Also, the ratio of gear teeth to base diameter of the gear may be high compared to currently available drivers. Thus, the teeth for engagement between the handle and the gear are, according to certain embodiments of the present invention, relatively numerous and small or fine for quiet, smooth, precise and close engagement, all with a lack of tooth play, while transmitting high torque.

The aforementioned are accomplished, according to certain embodiments of the present invention, because of an intimate engagement between the driving handle and each of the two pawls. According to certain embodiments of the present invention, the pawls and the handle have matching surfaces which are in extended contact when a pawl is in the torque driving mode. As such, according to certain embodiments of the present invention, more than a line contact therebetween transmits the torque to the pawls and then to the gear. According to certain embodiments of the present invention, those surfaces face tangentially to the gear at the point of tooth engagement, thereby transmitting torque at the optimum leverage and to the gear. Also, the matching surfaces may be arcuate and have a common center of curvature to produce the extended surface contact therebetween.

Also, according to certain embodiments of the present invention, a spring is applied for alternately urging the pawls into engagement with the gear. In some of these embodiments, the spring relates to the pawls in a self-adjusting contact with the pawls by sliding thereon, as needed. When one pawl is mechanically disengaged from the gear, the spring, according to certain embodiments of the present invention, automatically responds and is thus pressed to thereby exert an increased force on the other pawl. In some of these embodiments, the spring slides on both pawls for self-positioning of the spring on the two pawls.

Though certain embodiments of the present invention include two pivoting pawls, there is typically a firm stop action effective on the pawls when they are pivoted out of gear release mode. A line abutment, and that is firm, may also be applied between the pivoting pawls and the handle.

As will be appreciated by one of skill in the art, certain of the aforementioned embodiments of the present invention permit providing a miniature driver. This miniature driver is typically sensitive, strong, and smooth in its ratcheting action.

According to other embodiments of the present invention, a method of arranging one or more drivers according to certain embodiments of the present invention is also provided. Such a method is typically efficient and frequently presents a sturdy driver. Also considered to be part of certain embodiments of the present invention is the control of the parts during assembly so that the pawls and a cap release are properly positioned so that the cap can be released when desired. Further, according to certain embodiments of the present invention, the cap has a restrictor thereon to preclude incorrect rotation of the cap on the handle for assembly of the cap thereon. That is significant because, according to certain embodiments of the present invention, the cap includes a projection or web that is preferably positioned between the two pawls for proper pawl tooth release of the pawls from the gear.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
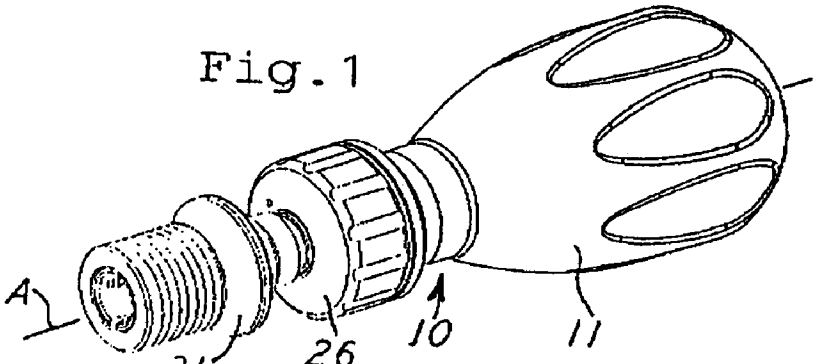
FIG. 1 is a front perspective view of an assembled driver according to one embodiment of the present invention.

Certain embodiments of the present invention will now be described with reference to the drawing figures, in which like reference numerals refer to like parts throughout.

FIG. 1 is a front perspective view of an assembled driver 10 (e.g., a screwdriver) according to one embodiment of the present invention. FIG. 1 illustrates that the driver 10 includes an elongated housing in the form of a handle 11 that is also illustrated in FIGS. 1-4. FIG. 1 also illustrates that the screwdriver 10 includes an attachment 12, which serves as a pawl positioner or actuator and that the attachment 12, along with other internal parts of the driver 10, are all oriented along a longitudinal axis A.

According to certain embodiments of the present invention, the driver 10 is a miniature screwdriver. Thus, the handle 11 illustrated in FIGS. 1-4 has a substantially spherical- or pear-shaped exterior shape to facilitate gripping by the palm of an operator's hand. The precision and the efficient transmission of rotation torque applied by the operator's hand allows for the miniature configuration which is shown in the above-discussed figures. However, other shapes and sizes are also within the scope of certain embodiments of the present invention.

Figure 3:
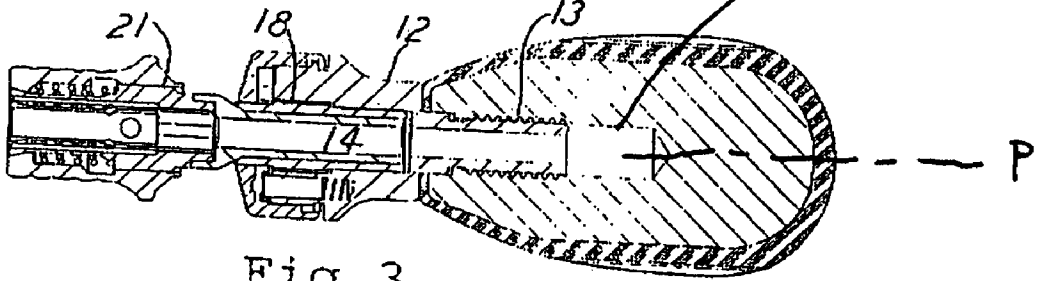
FIG. 3 is a sectional view taken on a plane designated by the line 3-3 in FIG. 2.
Figure 4:
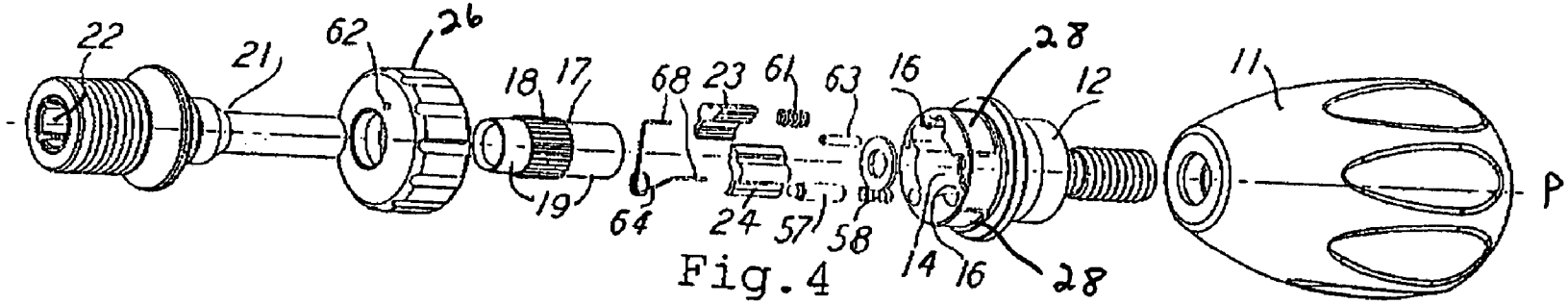
FIG. 4 is a exploded view of the driver illustrated in FIG. 1.

The attachment 12 included in the handle 11 is illustrated in FIG. 4 as being threaded and that can thus be screwed into the handle 11. More specifically, as illustrated in FIG. 3, a portion of the attachment 12 includes threads 13 and may be rotated (i.e., screwed) as a unit into the pear-shaped handle portion 11. The attachment 12 therefore presents an integral and fixed connection as a part of and with the remainder of the handle 11. As shown in FIG. 4, once the handle 11 and attachment 12 are connected to each other, the combination includes an axially extending hollow interior 14 and two pawl pockets 16.

As also illustrated in FIG. 4, according to certain embodiments of the present invention, a cylindrical spur gear member 17 that includes spur gear teeth 18 is rotationally snugly assembled with (i.e., screwed into) the handle 11 in the interior 14. The gear 17 typically has both of its axially extending ends 19 snugly rotationally supported in the interior 14.

FIG. 4 also illustrates a collet member 21 that is suitably rotationally connected to the gear member 17. The collet member 21 illustrated includes jaws 22 for clamping onto a work piece (not illustrated). The work piece may take the form of, for example, a screw, bolt, nut, or other rotational fastener or member which is to be driven by the driver 10.

The above-discussed handle 11 can rotate or orbit the pawl pockets 16 about the axis A in both directions and relative to the gear member 17. The pockets 16 are typically disposed radially outwardly of the gear teeth 18 and can rotate therearound.

Figures 5, 6, 7, 8, 14, 15:
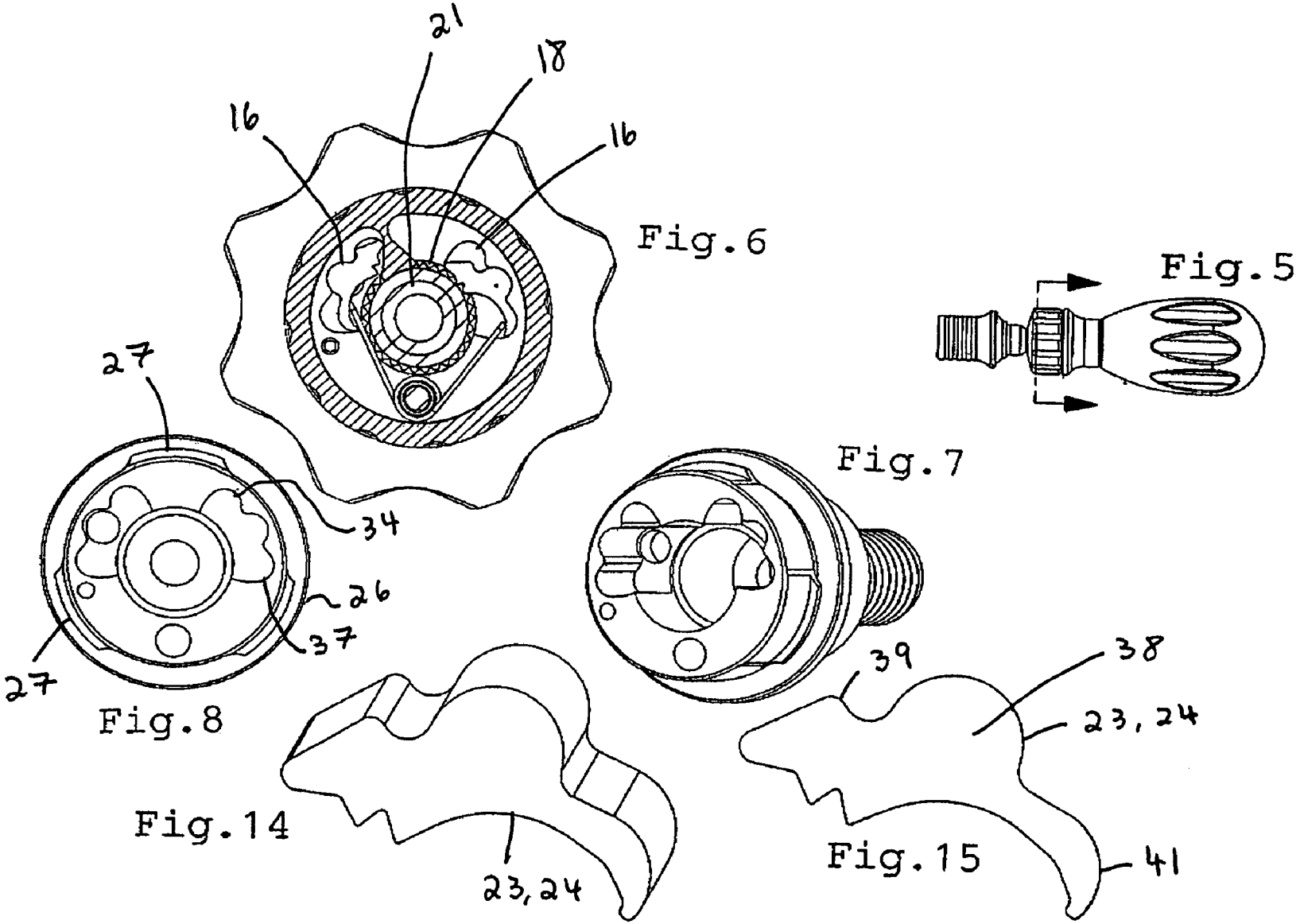
FIG. 5 is a side elevational view of FIG. 1, on a reduced scale.
FIG. 6 is an enlarged section view taken on a plane designated by the line 6-6 of FIG. 5.
FIG. 7 is an enlarged perspective view of a part seen in FIG. 4.
FIG. 8 is an end elevational view of FIG. 7.
FIGS. 14 and 15 are respectively perspective and front elevational views of a pawl seen in FIG. 11.

To induce rotation of the gear member 17 and consequent similar rotation of the collet member 21, two pawls 23 and 24 are pivotally disposed in the respective pockets 16 and are disposed generally radially of the circumference of the gear teeth 18, as seen in FIG. 6.

A cylindrical cap 26 that is cup-shaped and that fits over the axial end of the handle 11 is illustrated at least in FIGS. 1,4, and 8. The cap 26 includes three radially extending tangs 27 which serve as bayonet connectors with the three tangs 28 on the handle 11. Thus, according to certain embodiments of the present invention, the cap 26 can be moved axially onto the handle portion 12 and then rotated to bayonet-engage the cap 26 onto the handle 11. The cap 26 typically includes has a rim therearound, and there is typically included a web or projection which is pear-shaped in axial views thereof and that extends inwardly from the rim and to a location between the pawls 23 and 24. This location is also within the height of the gear teeth 18, as illustrated in FIG. 6.

Figure 9:
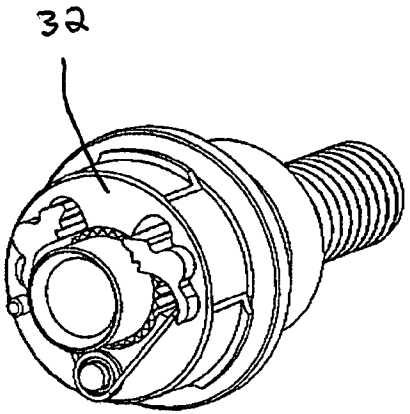
FIG. 9 is perspective view like FIG. 7, but with parts added thereto.
Figure 11:
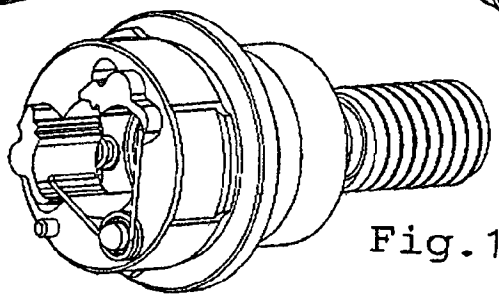
FIG. 11 is a perspective view like FIG. 9 but with a part removed.
Figure 12:
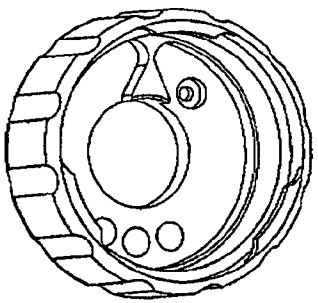
FIGS. 12 and 13 are respectively perspective and end elevational views of the cap part in FIG. 4.
Figure 13:
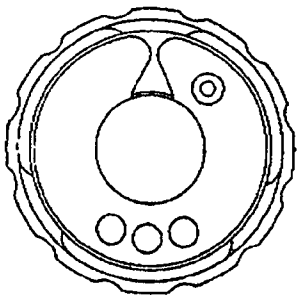

As illustrated in FIGS. 9 and 11, the pawls 23 and 24 extend beyond the axial extent of the gear teeth 18 and beyond the planar wall 32 of the handle 11. Thus, according to certain embodiments of the present invention, the pawls 23, 24 present an extension or overhang in their lengths and, upon rotation of the cap 26, as the cap 26 is rotationally piloted on the housing, the above-discussed web or projection engages those overhanging ends of the pawls 23 and 24 and thereby pivots the pawls 23, 24 out of engagement with the gear member 17 and/or gear teeth 18, as selected.

The above-discussed attachment 12 has its two pawl pockets 16 in what is seen as the upper half of the portion 12, as seen in FIG. 8. Those pockets 16 are, according to certain embodiments of the present invention, mirror images of each other, and they both typically include three circular outwardly extending and arcuate pockets 34, 36, and 37, each one being essentially semi-circular in axial view per FIG. 8. The pockets 34, 36, and 37 are typically open to the central opening 14.

The two pawls 23 and 24 are typically identical to each other in shape in axial view, and they substantially match the shape of the pockets 16 in axial view. As illustrated in FIG. 15, the pawls 23, 24 have a central portion 38 and two opposite end portions 39 and 41. The central portion 38 is typically a fulcrum or pivot portion and, as shown in FIG. 15, can be at least substantially semi-circular and snugly slidable in and conforming to the shape of the semi-circular pocket portion 36. The two pawl end portions 39 and 41 are respectively disposed in the pockets 34 and 37. As such, the pockets 16 and the pawls 23 and 24 are, according to certain embodiments of the present invention, substantially T-shaped in the axial view.

Figure 10:
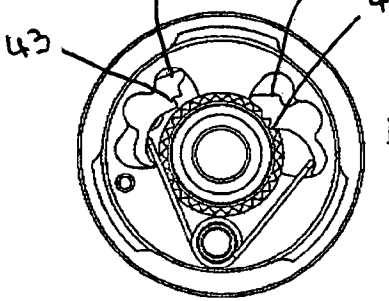
FIG. 10 is an end elevational view of FIG. 9.

The pawl portions 39 have spur teeth 42 facing the gear teeth 18. The locations of gear tooth engagement are typically at the respective 10/11 O'clock and 1/2 O'clock locations, as illustrated in FIG. 10, and these engagements are labeled 43 and 44. Typically, each of these engagements comprehends a circumferential length of several teeth on the gear member 17 and, of course, also with regard to the gear-engaged teeth 42 on the pawls 23, 24.

The handle 11 typically has a concave and at least approximately semi-circular surface 46, as shown herein, defining a pocket 34 and centered about the pawl pivot axis P. Each pawl 23, 24 is shown to have a convex at least approximately semi-circular surface 47 of the same size and shape as the surface 46 and fully overlying and fully flush with the housing surface 46. Therefore, the two surfaces are defined as being matingly matched. Also for each pawl 23, 24, the housing has a concave at least approximately semi-circular surface 48. Each pawl 23, 24 has a convex at least approximately semi-circular surface 49 fully overlying and fully flush with the housing surface 48 in the pawl tooth-engaged mode, and therefore being defined as being matingly matched, as seen in FIGS. 6 and 10.

Each pocket 16 is defined by an arcuate concave surface 51, centered on the pivot axis P and which extends contiguous with each pocket 16 surface 48 and presents a sliding surface for sliding contact by the pawl end 52 for approximately ten degrees of pivot sliding of the pawl on the surface 51. In that sliding action, the pawls swing or pivot about the axis P and between gear tooth engaged mode and gear tooth released mode, as shown respectively with the pawls 24 and 23 in FIGS. 6 and 10.

With regard to both surfaces 46 and 48, they face the tooth engaged locations 43 and 44. One of skill in the art will appreciate that there are imaginary straight lines between each of those surfaces and the respective tooth-engaged locations. One of skill in the art will also appreciate that those lines are respectively at least substantially tangential to the gear teeth 18. This results in the line of rotation force creating the torque which is applied through the handle 11 and is thus applied at an optimum angle onto the gear 17 for optimum torquing effect. Also, in and during the driving mode, both surfaces 46 and 48 are simultaneous applied to the respective pawl so there is firm and full application of the operator's hand rotation action applied onto the gear 17.

As discussed above, each pawl 23 and 24 includes at least three portions: the central pivot portion 38, the engageable end portion 41, and the opposite end portion 39. Typically, the two end portions 39,41 are swingable in the handle pocket openings 16 and the handle surface 48 extends into the length 51, which is centered about the pivot axis P. Thus, according to certain embodiments of the present invention, the pawls 23, 24 are securely retained in the respective housing pockets 16 while being free to swing toward and away relative to the gear member 17 at the two opposite ends 39 and 41 of each pawl 23, 24. That is, the pawls 23, 24 typically have convex tips 52 slidable on the arcuate housing surfaces 51 which are centered on pivot axis P. The housing has surfaces 51 and 53 centered about axis P, and these surfaces 51, 53 typically face each other to thereby restrict the pawls from moving out of the handle pockets 16 because the pawls have ends 52 and 50 in respective sliding contact with those surfaces 51 and 53.

Further, when a pawl is in the full gear tooth released mode, as with the pawl 23 illustrated in FIG. 10, there is a line contact at 54 on the pawl and a surface 56 defining the pocket 33. That gives a firm and definite stop point for the pivot of the release pawl.

The representative arrangement described above regarding the full surface engagement between the pawls and the handle as at surfaces 46 and 48 of the handle, produces a triangle of force application with the respective tooth-engaged locations.

According to certain embodiments of the present invention, the cap 26 is suitably limitedly or restrictively rotatably attached to the handle, and the cap 26 may be in any conventional attachment arrangement, such as the bayonet type attachment arrangement shown where the flanges 27 and 28 interengage in the conventional manner to axially fix the cap 26 relative to the handle but to also allow a slight rotational movement of the cap 26. Also, according to certain embodiments of the present invention, the cap 26 is releasably retained in any one of three rotated positions for determining the ratcheting and drive directions. Those positions are typically established by a pin 57 which is yieldingly urged axially leftward in FIG. 1 by spring 58 to sequentially seat the pin 57 into a selected one of the three holes 59 in the cap 12. That adjustment is simply a self-releasing over-ride arrangement so that the cap can be rotated over the pin 57 to any one of the three positions.

Figure 2:
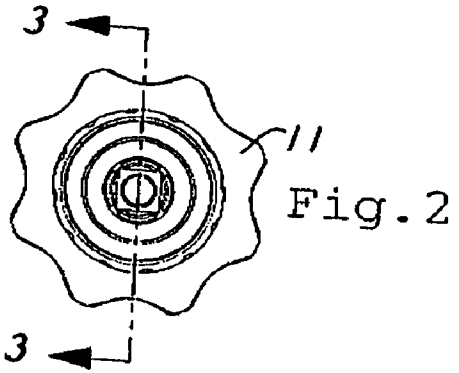
FIG. 2 is a front end elevational view of FIG. 1, on a reduced scale.

The rotation of the cap is typically limited by the pawls 23 and 24 which are axially positioned to interfere with the web 29 in the rotation of the cap. While both pawls 23 and 24 typically extend into the cap 26, the pawl 23 can be of a shorter length and is urged into the cap 26 by a spring 61 illustrated in FIG. 1. In such an arrangement, the pawls 23 and 24 can be of different lengths, and the pawl 24 is shown in FIG. 2 to be longer. As such, it fully occupies the length, or depth, of its pocket 16 and extends therebeyond, as seen in FIGS. 9 and 11. However, the pawl 23 can be of a shorter length. In such arrangements, it does not fully occupy the axial length of its pocket 16 which accommodates the spring 61 and, under the urging of the spring 61, pawl 23 extends beyond the length of the gear teeth 18, as does the pawl 24. Also, according to certain embodiments of the present invention, the pawls extend beyond the handle wall 32.

In assembling the driver 10, the cap 26 is typically axially moved onto the housing 12 and the cap web 29 is disposed between the pawls. With assembly positioning of the bayonet projections, namely offset from each other, the web 29 is aligned with the forces down on the spring-urged pawl 23 and, upon rotation of the cap out of that positioning, the pawl 23 is released and the web 29 is rotated to a position between the pawls 23 and 24 which are then in the arcuate path of rotation of the web to thereby preclude over-rotation of the cap relative to the handle.

According to certain embodiments of the present invention, an access hole 62 in the cap 26 permits the insertion of a pin (not illustrated) into the cap and onto the pawl 23 to push the pawl 23 against the spring 54, thereby permitting the cap to be rotated beyond the pawl 23 and off of the bayonet connection of the cap 26 with the handle 12 and for disassembly.

In assembly, according to certain embodiments of the present invention, there is a fixed projection 63 on the handle 12 extending into the cap 26. The projection 63 typically provides rotation interference upon rotation of the cap 26 and its web 29 which can abut the projection 63. Thus, the cap typically cannot be over-rotated in the counterclockwise direction, as viewed in FIG. 6. Also, while assembling the driver 10, the web 29 will, according to certain embodiments of the present invention, always be properly positioned between the pawls and will not rotate therebeyond.

According to certain embodiments of the present invention, a spring 64 is coiled and piloted on the pin 57 on the handle. The spring typically has two legs 67 extending respectively into contact with the pawls 23 and 24. The spring tips 68 are typically angulated and in sliding contact with the pawl concave surfaces 69 and therefore are self-adjusting along those surfaces in response to pivot action of the pawls. The spring 64 illustrated herein has its two legs 67 tensioned for exerting radially outward force on the pawls. Therefore, when one pawl is spring-forced out of gear tooth engagement by the cap web doing so, the spring 64 is placed under tension such that the other spring leg receives an increased force to urge and hold the other pawl into gear tooth engagement, as seen in FIG. 6. When such an arrangement with the pawls 23 and 24 is implemented, the spring legs 67 are typically always in sliding contact with the pawl surfaces 69 to pivotally urge the pawls 23 and 24 toward and sometimes into tooth engagement with the gear teeth 18, as illustrated in FIGS. 6 and 10.

The web 29 is typically shaped to cam under the pawls 23 and 24 so that, upon rotation of the cap 26, the pawl is disengaged from the gear 18, as illustrated in FIG. 6. With that maneuver, where the cap 26 has been rotated clockwise from the handle end, the drive is also typically clockwise.

According to certain embodiments of the present invention, there are two substantially handle T-shaped pockets 16 with the central portion 34 and the two flanking arm portions 36 and 37, all forming a substantially right angled relationship of the T-shape upright stem and then to cross bar at right angles to that stem. Likewise, the two pawls are typically at least substantially T-shaped to at least substantially conform to the shape of the handle pockets 16 and be matingly matched therewith. According to certain embodiments of the present invention, there are two rotation drive surfaces 46 and 48 on the handle 12, and they both apply a drive torque tangential to the gear teeth 18. In that arrangement, the gear teeth can be small and the drive is firm and precise without lost drive motion between the handle and the gear. With the surfaces 48 and 49, they are of two dimensional flush and overlying contact with each other, and that is defined as being substantially devoid of only line contact.

One representative method of arranging a tool (e.g., the screwdriver 10) is disclosed in this description. This method typically includes the arrangement with the pawls and the spring 67 and the cap rotation and the positioning of the web between the pawls for cap rotation restrictions. It also typically includes the release of the cap from its restricted rotation, all as described herein. However, other methods are also within the scope of the present invention.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A ratcheting driver configured to rotationally drive a work piece, the driver comprising:

a handle that includes a longitudinal axis and a hollow interior;

a gear that includes gear teeth positioned thereon, wherein the gear is rotatably supported along the longitudinal axis in the hollow interior and wherein the gear is configured to rotationally drive a work piece;

a first pawl and a second pawl, each pivotally supported by the handle adjacent to the gear and being orbital about the axis upon and with rotation of the handle, wherein at least one of the pawls includes pawl teeth engageable with the gear teeth at a respective location on the gear teeth and wherein the pawl teeth are configured to transmit rotation from the handle to the work piece;

a spring configured to pivot the at least one pawl and to yieldingly urge the at least one pawl into rotational driving tooth engagement with the gear teeth; and a force transmitting member configured to selectively pivot the at least one pawl out of rotational driving tooth engagement with the gear teeth, wherein the handle includes two spaced apart surfaces and wherein each of the pawls include two spaced-apart surfaces in respective sliding contact with the handle surfaces and with the handle surfaces being disposed to face the location for supporting the pawls in the teeth engagement of the pawls with the gear teeth at the location and further configured to urge the pawls to orbit about the axis and to thereby urge rotation of the gear about the axis.

2. The ratcheting driver of claim 1, wherein one of the handle surfaces and one of the pawl surfaces are of substantially the same shape and substantially fully overlie each other in two-dimensional contact during rotation of the gear.

3. The ratcheting driver of claim 1, wherein the spring is in sliding contact with the least one of pawl, wherein the spring is configured to move along the at least one pawl, and wherein the spring is further configured to urge the at least one pawl into driving tooth engagement with the gear.

4. The ratcheting driver of claim 1, wherein the force transmitting member is rotatable on the handle and a stop interposed between the force transmitting member and the handle, thereby being configured to restrict rotation of the force transmitting member in one direction during assembly of the driver.

5. A method of arranging a ratcheting driver for rotationally driving a piece, the method comprising the steps of:

providing a handle that includes a hollow interior, a longitudinal axis, and two pockets supported by the handle;

placing two pivotal pawls in the pockets for orbital motion about the axis;

attaching a cap adjacent to the handle, wherein the cap is rotatable relative to the handle and about the axis and wherein the cap includes a portion extending toward the axis and between the pawls in final assembly and is configured to interfere with the pawls to restrict the rotation of the cap; and placing a stop on the handle to substantially preclude rotation of the cap in one direction of rotation about the axis to assure positioning of the portion between the pawls.

6. The method of claim 5, further comprising the step of:

providing a spring adjacent one of the pawls for urging the pawl in a first direction; and initially positioning the projection onto the one pawl for depressing the one pawl against the spring and then rotating and axially moving the cap relative to the handle for consequent positioning of the projection between the pawls in assembling the cap relative to the handle.

7. A driver, comprising:

a handle that includes a longitudinal axis and a hollow interior;

a gear that includes gear teeth positioned thereon, wherein the gear is rotatably supported along the longitudinal axis in the hollow interior and wherein the gear is configured to rotationally drive a work piece;

a pawl pivotally supported by the handle adjacent to the gear and being orbital about the axis upon and with rotation of the handle, wherein the pawl includes pawl teeth engageable with the gear teeth at a respective location on the gear teeth and wherein the pawl teeth are configured to transmit rotation from the handle to the work piece;

a first force transmitting member configured to pivot the pawl and to yieldingly urge the pawl into rotational driving tooth engagement with the gear teeth; and a second force transmitting member configured to selectively pivot the pawl out of rotational driving tooth engagement with the gear teeth, wherein the handle includes two spaced apart surfaces and wherein the pawl includes two spaced-apart surfaces in respective sliding contact with the handle surfaces and with the handle surfaces being disposed to face the location for supporting the pawl in the teeth engagement of the pawl with the gear teeth at the location and further configured to urge the pawl to orbit about the axis and to thereby urge rotation of the gear about the axis.

8. A driver, comprising:

means for providing a handle that includes a hollow interior, a longitudinal axis, and two pockets supported by the handle;

means for placing two pivotal pawls in the pockets for orbital motion about the axis;

means for attaching a cap adjacent to the handle, wherein the cap is rotatable relative to the handle and about the axis and wherein the cap includes a portion extending toward the axis and between the pawls in final assembly and is configured to interfere with the pawls to restrict the rotation of the cap; and means for placing a stop on the handle to substantially preclude rotation of the cap in one direction of rotation about the axis to assure positioning of the portion between the pawls.

* * * * *